US009011045B2

(12) United States Patent
Muniz-Martinez

(10) Patent No.: US 9,011,045 B2
(45) Date of Patent: Apr. 21, 2015

(54) SELF CONTAINED MARINE RISER FAIRING

(75) Inventor: Adan H. Muniz-Martinez, Katy, TX (US)

(73) Assignee: Transocean Sedco Forex Ventures Limited, George Town Grand Cayman (KY)

( * ) Notice: Subject to any disclaimer, the term of this patent is extended or adjusted under 35 U.S.C. 154(b) by 0 days.

(21) Appl. No.: 13/493,821

(22) Filed: Jun. 11, 2012

(65) Prior Publication Data

US 2012/0321394 A1 Dec. 20, 2012

Related U.S. Application Data

(60) Provisional application No. 61/496,631, filed on Jun. 14, 2011.

(51) Int. Cl.
*F15D 1/10* (2006.01)
*E21B 17/01* (2006.01)

(52) U.S. Cl.
CPC ..... *E21B 17/012* (2013.01)

(58) Field of Classification Search
CPC ..... B63B 2021/504; B63B 21/663
USPC ..... 405/195.1, 211, 216, 214; 114/243; 441/3, 4, 5
See application file for complete search history.

(56) References Cited

U.S. PATENT DOCUMENTS

| | | | | |
|---|---|---|---|---|
| 3,194,204 | A | 7/1965 | Nichols | |
| 5,439,128 | A * | 8/1995 | Fishman | 220/8 |
| 5,738,034 | A * | 4/1998 | Wolff et al. | 114/243 |
| 5,984,584 | A | 11/1999 | McMillan et al. | |
| 6,517,289 | B1 * | 2/2003 | Coakley et al. | 405/216 |
| 2008/0166185 | A1 | 7/2008 | Baugh | |

* cited by examiner

*Primary Examiner* — Doug Hutton, Jr.
*Assistant Examiner* — Patrick Lambe
(74) *Attorney, Agent, or Firm* — Norton Rose Fulbright US LLP

(57) ABSTRACT

A collapsible marine riser fairing that includes members configured to retract into a storage space and be deployed from the storage space when needed. The collapsible fairing is semi-permanently attached to the riser.

11 Claims, 8 Drawing Sheets

SELF CONTAINED MARINE RISER FAIRING

CROSS-REFERENCE TO RELATED APPLICATIONS

This application claims priority to U.S. Provisional Application No. 61/496,631 filed Jun. 14, 2011.

TECHNICAL FIELD

A storage system for a marine riser fairing that would be semi-permanently attached to a slick joint or imbedded in a section of a buoyancy or encapsulation module in such a manner that it would eliminate the need to remove the fairing when pulling the riser out of the water and stowing it in the riser bay.

BACKGROUND OF THE INVENTION

This invention is meant to tackle the three primary problems with the use of marine riser fairings, the first being the time it takes to install/remove a fairing, the need to plan for a separate storage location for riser fairings aboard the drilling vessels, and the need to move the fairings from storage to the installation station.

This problem has been tackled in the past by trying to reduce the time it takes to install riser fairings. Several ways in which this has been achieved is by simplifying the steps needed to secure the connections/attachments to the buoyancy joints and reducing the fairing length/size for ease of handling.

BRIEF SUMMARY OF THE INVENTION

The invention is directed to a self contained collapsible/expandable marine riser fairing that would expand from and collapse int o a storage system strapped to a slick or buoyant or encapsulated joint of the riser.

The collapsible marine riser fairing comprises members configured to retract into a storage space and be deployed from the storage space when needed, wherein the collapsible fairing is semi-permanently attached to the riser. The storage space is a storage box that additionally comprises low friction attachment straps for attaching the box to the riser. The collapsible riser fairing can be stowed within a buoyancy joint or an encapsulated joint of the riser.

The members of the collapsible fairing comprises interlocking panels that are adapted to fold into the storage space and form a pyramid type shape when deployed. The interlocking panels include locking studs. Additional material is attached to the outside of the members in order to create a smooth foil when the members are deployed.

The members of the collapsible fairing comprise foldable sections in which the foldable sections are adapted to collapse to a map fold. The foldable sections are adapted to collapse to an accordion fold.

The fairing further comprises a deployment mechanism. The deployment mechanism is a scissor jack.

A member of the collapsible fairing comprises a wing section. The members comprise two wings sections that are spaced apart and attached to the riser. Malleable material is attached to and between the two wing sections and is adapted to form a smooth foil when the collapsible fairing is deployed.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 5 is the profile view of a riser with a deployed collapsible fairing shown straight on;

DETAILED DESCRIPTION OF THE INVENTION

Figure 1:
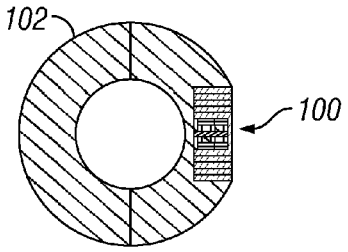
FIG. 1 is a cross section of a riser showing an embodiment of the invention embedded therein.
Figure 2:
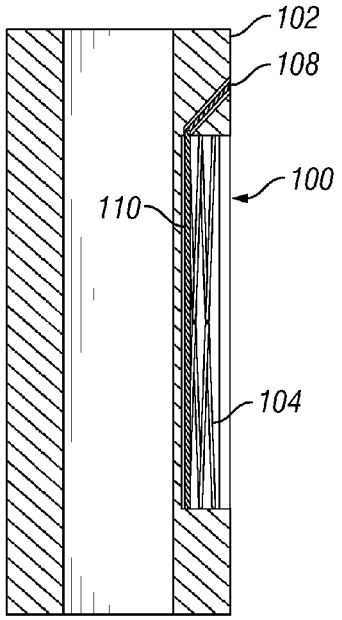
FIG. 2 is a profile cross section of a riser showing a scissor jack that may be used to deploy collapsible fairings.
Figure 3:
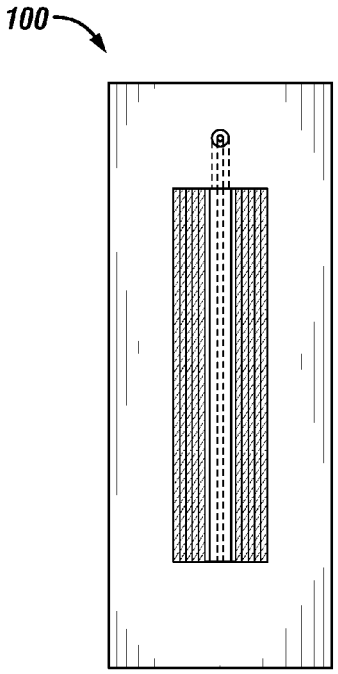
FIG. 3 is a plane view of the top of a collapsible fairing storage box.
Figure 4:
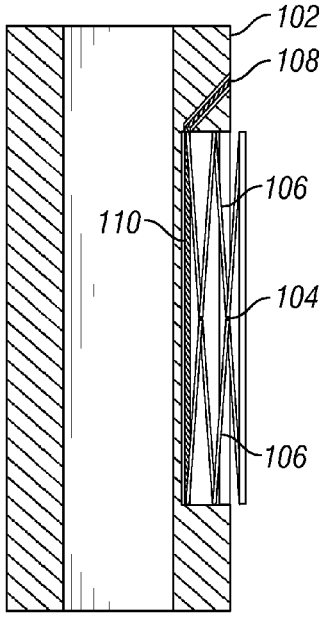
FIG. 4 is a cross section of a collapsible fairing storage box illustrating a scissor jack with cross bars.

The invention is directed to a self contained collapsible/expandable marine riser fairing that would expand from and collapse into a storage system strapped to a slick, encapsulated or buoyant joint of a riser. This would be achieved by means of a mechanical system such as a rotational mechanism to activate a scissor jack that would then elevate the sections of the fairing, or a push/pull motion that would lock the sections in place via the use of locking studs or other securing methods. Once the fairing is deployed or retracted the riser would either be lowered into the water or lifted from the drill floor on its way to the riser bay with the faring storage system still attached. Self-contained fairing and collapsible fairing are used herein interchangeably.

The faring storage system would be semi-permanently attached to the riser by means of low friction straps and a special frame for either a buoyant or slick joint. This frame would allow the faring to rotate around the riser joint and keep its end always facing downstream from the current.

The shape of riser will determine what shape will be used for the containment area. It may be box shaped, or of a more efficient configuration. The shape will be dependent on the riser slick/buoyant joint design and the location of the choke and kill lines with respect to the largest outer diameter of the joint.

In the case of a buoyant or encapsulated joint, the fairing storage unit would be fitted in a special buoyancy or encapsulation module containing a series of removable sections, these would allow the installation of the fairing containment system in such a way that it would be free to rotate about the vertical axis of the riser joint while keeping some of the buoyancy characteristics of the module. The removable sections would be secured to the containment box in such a manner that would allow them to also change direction with the fairing and current.

The slick joint version of the storage unit would be designed in a manner where its placement would locate it above the choke and kill lines allowing for rotational movement about the vertical axis. A special frame would be used to strap the containment system to the slick joint and the straps would be made of a low friction material in order to allow the fairing to maintain its orientation downstream from the current. The frame would have its dimensions dictated by the location of the choke/kill lines and the maximum clearances between the joints while stored in the riser bay. The frame may be circular in nature with channels cut into the outer surface in order to guide the straps and holes cut through it to allow the choke/kill lines to pass. The faring would be deployed and recovered using a mechanical system, requiring the use of a drill or any other more appropriate mechanisms.

The deployment system could be similar but not limited to a system that expands or collapses a crossbar, similar to a scissor jack frame allowing for a simple turning motion to activate the mechanism. In the case where such a system is impractical the fairing would be pushed or pulled from its containment. A locking system for the fairing sections would then be utilized to keep them in place. The system could use a pulley connected to wires that would rotate pins allowing the sections to move in or out of the containment system.

The fairing could be stowed within the container in any number of ways. For example, a pyramid/accordion type system could be used where different sections would be lifted from the compartment until their internal guides reach a stopper at the correct height of each section. The length of the pyramid along the vertical will remain equal in all sections. Only the transverse width will vary with height. (See FIGS. 6, 7, and 26-29). Alternatively, a map type system could be used where the faring sides would fold upon themselves as the deployment mechanism is retracted. (See FIGS. 9-11 and 23-25) Alternatively, a folded wing type configuration could be used that would form part of the riser curvature and be pulled out into position and secured with a snapping mechanism. (See FIGS. 14, 15 and 32-34) Dimensions of the fairing will be optimized to fit riser storage and to reduce vortex induced vibration Depending on the riser other deployment solutions could be applied to the concept.

The invention keeps the riser fairing stowed within a container that is attached to the riser instead of separately on deck. In one embodiment, the person responsible for deployment will only need to use one tool or motion in order to deploy the fairing.

An embodiment of the invention is a collapsible fairing that fits into a storage system and is attached to the riser in a way that allows the riser to be stored with the fairing storage box still attached to it. This will eliminate the need to remove the fairings every time the riser is deployed or retrieved.

The invention also makes the deployment of the riser simpler and safer; since it only needs one tool or a simplified motion to deploy the fairing from its containment enclosure. Thus, eliminating the need to lift fairing sections into place while running the riser into or out of the water.

Figure 5:
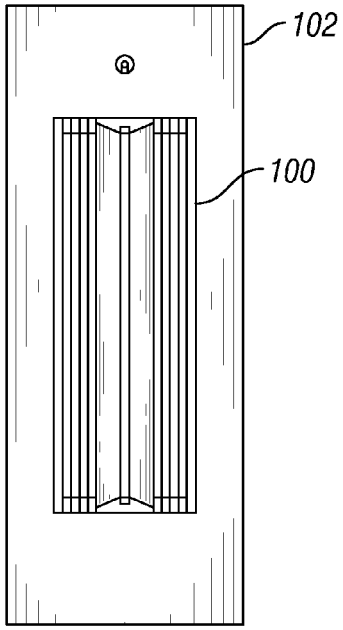

FIGS. 1-5 illustrate an example of the collapsible fairing 100 in a riser 102 which is deployed using a scissor jack 104. The collapsible fairing 100 in these figures is fully contained within the boundaries of the riser 102. A scissor jack 104 comprising crossbars 106 may be used to deploy the fairing 100 through a power tool access point 108 which may be connected to a long screw 110 as demonstrated in FIGS. 2 and 4. When the screw 110 is turned the cross bar will move in a scissor like motion and increase the height of the top section, thereby deploying the collapsible fairing 100. FIG. 5 illustrates a deployed collapsible fairing 100.

Figure 6:
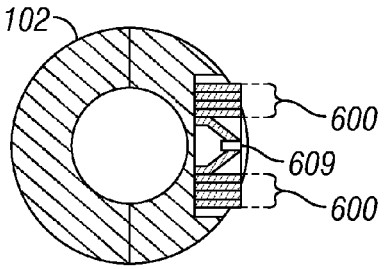
FIG. 6 is a cross section of a riser showing a stowed collapsible fairing.
Figure 7:
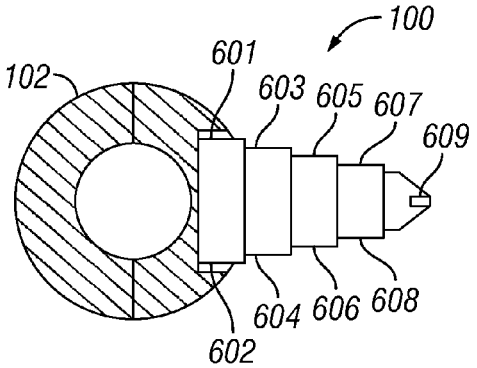
FIG. 7 is a cross section of a riser showing a deployed collapsible fairing.
Figure 8A:
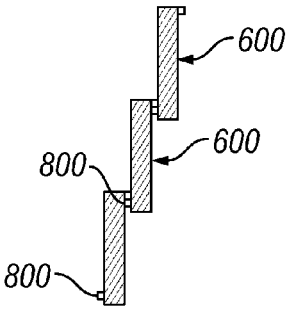
FIG. 8 is an example of a push-pull locking mechanism for the collapsible fairing.
Figure 8B:
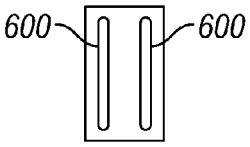

FIGS. 6-15 illustrate example embodiments of the structure of the collapsible fairing 100. FIGS. 6-8 show one embodiment of the collapsible fairing 100 structure which uses interlocking fairing sections 600. In FIGS. 6 and 7 the structure of the collapsible fairing 100 is comprised of a fairing sections 600, individually labeled 601, 602, 603, 604, 605, 606, 607, 608, and an end section 609 that may be pulled out of the riser 104. For example, when the top section 609 is pull away from the riser 102, the top section 609 will extend away from the riser and lock into place in fairing sections 607 and 608. With additional pulling, sections 607 and 608 will lock into place with sections 605 and 606, and so forth. FIG. 6 illustrates the stored collapsible fairing 100, while FIG. 7 illustrates the deployed collapsible fairing 100. The fairing 100 may lock in place via the use of locking studs 800 as demonstrated in FIG. 8 or other securing methods.

Figure 9:
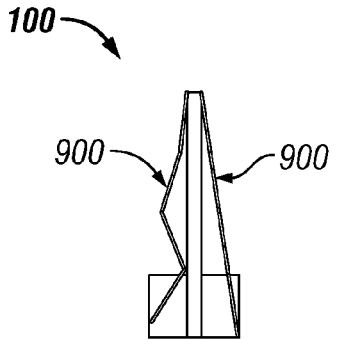
FIG. 9 is a cross section of a partially deployed collapsible fairing.
Figure 10:
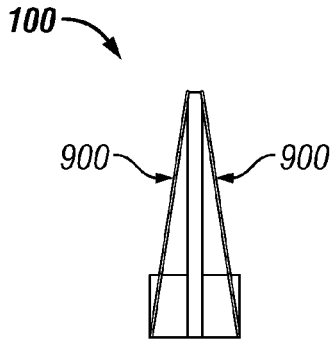
FIG. 10 is a cross section of the fully deployed collapsible fairing of FIG. 9.
Figure 11:
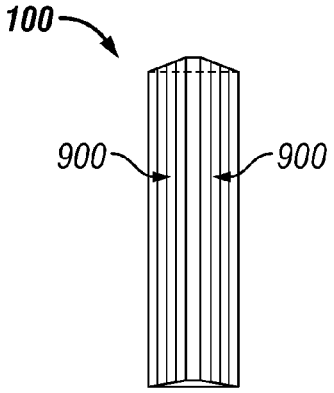
FIG. 11 is another view of the deployed collapsible fairing of FIGS. 9 and 10.

FIGS. 9-11 illustrate another example embodiment of the collapsible fairing 100 structure. In this embodiment, the collapsible fairing 100 is comprised of foldable sections 900. FIG. 9 illustrates a partially deployed fairing 100 while FIGS. 10 and 11 illustrate two deployed views of this embodiment of the collapsible fairing 100.

Figure 12:
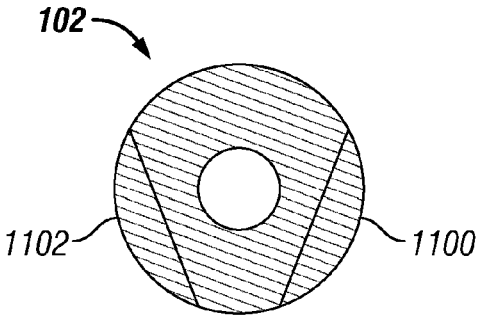
FIG. 12 is a cross section of another embodiment of the collapsible fairing illustrating a stowed collapsible fairing.
Figure 13:
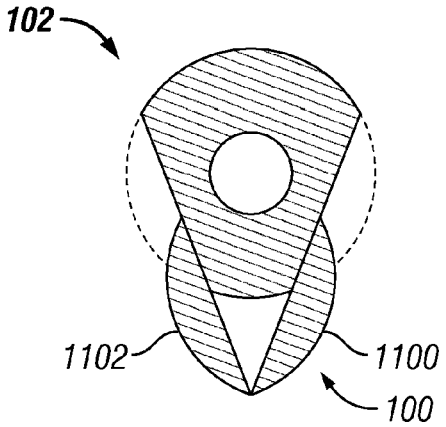
FIG. 13 is the deployed collapsible fairing of FIG. 12.

FIGS. 12 and 13 illustrate a further embodiment of the collapsible fairing 100 structure. In this embodiment the fairing 100 comprises two cut out sections 1100 and 1102 of the riser 102. The two cut out sections 1100 and 1102 slide relative to the riser 102, until the end of the slide when the cut out sections 1100 and 1102 are rotatable towards each other, such that the tips of the cut out sections 1100 and 1102 meet to form a fairing, as illustrated in FIG. 13. The sections are attached to the riser in the stored position by means of rail glides or slides (not shown). The two end sections of the cut out sections 1100 and 1102 are attached together and the opposing end sections are locked into place at the riser 102 when in a deployed position, thereby locking the cut out sections 1100 and 1102 in the deployed position. In this case the buoyancy module would be composed of two sections. An inner section that would contain the buoyant material along with some guide channels cut into it. The outer section would contain a rail that would either be made of a low friction material or be water lubricated. The outer section could also be neutral or buoyant depending on how the buoyancy impacts the rotation. It can be constructed of two half sections (one section would contain the fairing, while the other will be bare) that would be bolted together on top of the lower section.

Figure 14:
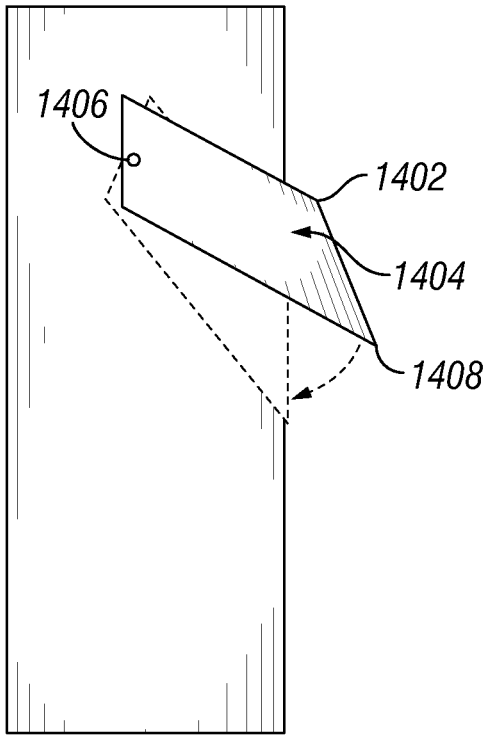
FIG. 14 is a profile view of a deployed collapsible fairing comprising rotatable wings.
Figure 15:
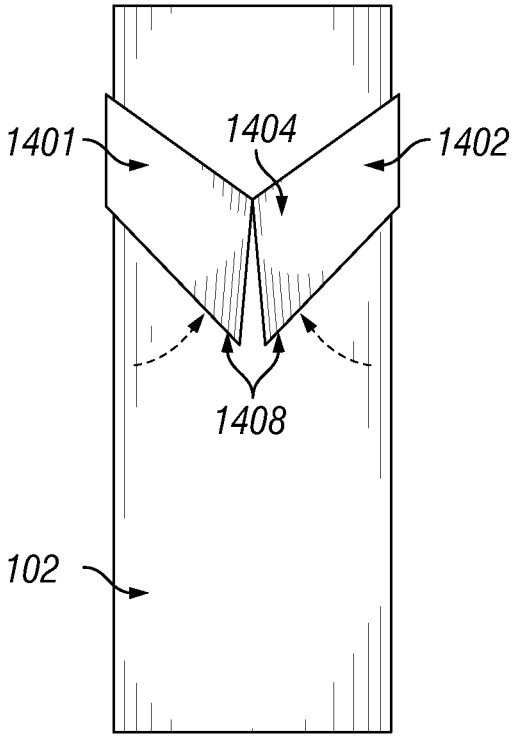
FIG. 15 is the stowed collapsible fairing of FIG. 14.

FIGS. 14 and 15 illustrate another embodiment of the collapsible fairing 100. In this embodiment two wing like sections 1401 and 1402 attached to each other at corners 1404 are laid flush against the riser 102 in the stored position as shown in FIG. 15. The wing like sections 1401 and 1402 are attached to the riser 102 at end 1406 by a means that allows the wing like sections 1401 and 1402 to pivot. The collapsible fairing 100 is deployed by rotating the wings away from the riser 102 and securing corners 1408 together. This embodiment may also be attached to the riser as described above for FIGS. 12 and 13.

Figure 16:
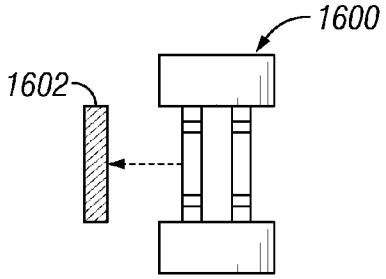
FIG. 16 illustrates a buoyancy joint with a section removed and the removable section of the joint.
Figure 19:
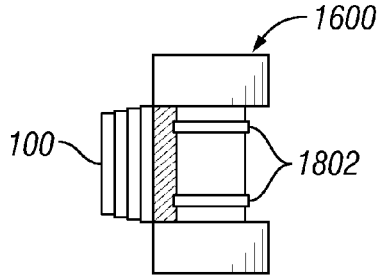
FIG. 19 is a buoyancy joint with a collapsible fairing storage box attached and the collapsible fairing deployed.
Figure 17:
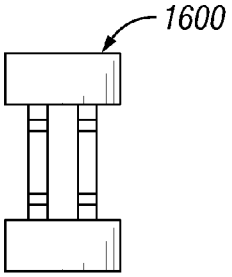
FIG. 17 is a buoyancy joint with a section removed.
Figure 20:
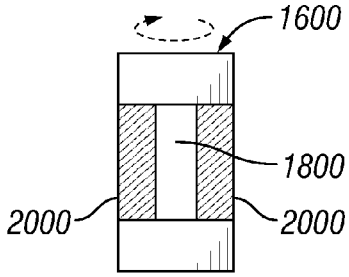
FIG. 20 is a buoyancy joint with a collapsible fairing storage box attached with additional material around the box.
Figure 18:
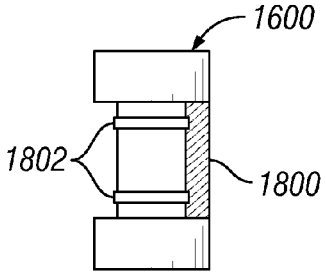
FIG. 18 is a buoyancy joint with a collapsible fairing storage box attached.
Figure 21:
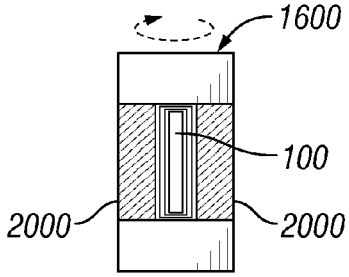
FIG. 21 is a buoyancy joint with a collapsible fairing storage box attached and the collapsible fairing deployed with additional material around the box.
Figure 22:
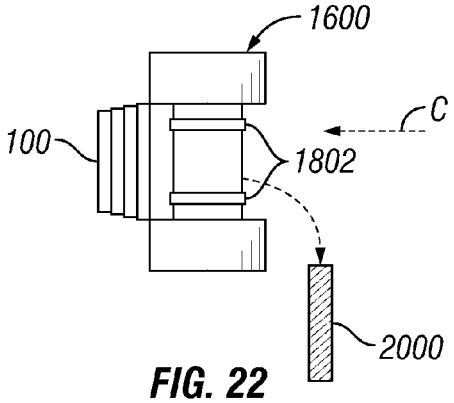
FIG. 22 is a buoyancy joint with a collapsible fairing storage box attached and the collapsible fairing deployed and also illustrates the removable section of the buoyancy joint.
Figure 23:
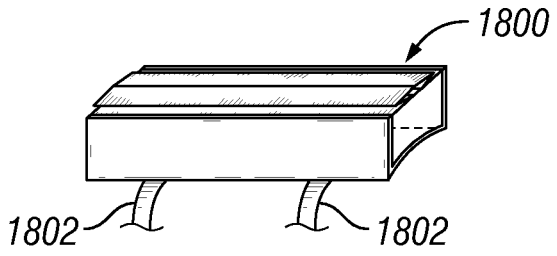
FIG. 23 is a collapsible fairing storage box with attachment straps.
Figure 24:
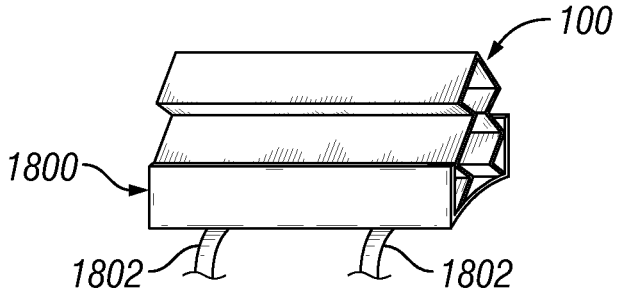
FIG. 24 is a collapsible fairing storage box with attachment straps with a collapsible fairing partially deployed.
Figure 25:
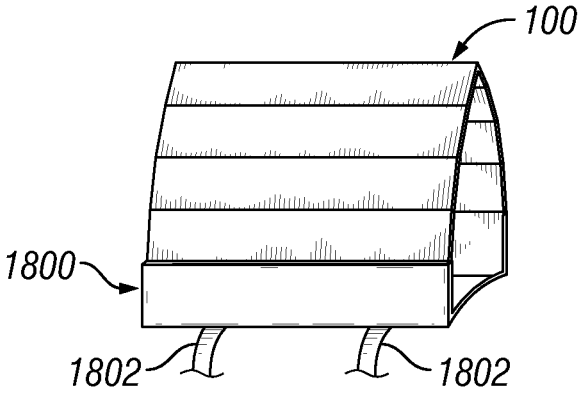
FIG. 25 is a collapsible fairing storage box with attachment straps with the collapsible fairing of FIG. 24 fully deployed.

FIGS. 16-21 illustrate an embodiment of the invention, where the collapsible fairing 100 is contained within a buoyancy joint 1600 of the riser. FIG. 16 shows a removable section 1602 of the buoyancy joint 1600. FIG. 17 also shows the modified buoyancy joint 1600 without the removable section 1602. In place of the removable section 1602, a fairing storage box 1800 is attached to the buoyancy joint 1600, as shown in FIG. 18. The fairing storage box may comprise six sides including a door or doors located on the top of the fairing storage box. The fairing storage box may also comprise only a base plate to which the sides of the collapsible fairing are attached. In stowed form, the collapsible fairing may form the sides and the top of the fairing storage box. The fairing storage box is attached to the buoyancy joint by means of low friction straps 1802 to allow for movement of the fairing around the circumference of the buoyancy joint 1600. FIG. 19 illustrates the collapsible fairing 100 after being deployed from the fairing storage box 1800. The current C in FIG. 19 is flowing in the direction of the arrow. Additional buoyancy or buoyancy neutral material 2000 maybe incorporated around the fairing storage box 1800 such that the circumference of the buoyancy joint 1600 is maintained through the section incorporating the fairing storage box 1800, as shown in FIG. 20. FIG. 21 illustrates the buoyancy joint with additional material 2000 and with the collapsible fairing 100 deployed. FIG. 22 also shows the deployed collapsible fairing 100 without the removable section 1602. FIG. 23 shows an example of a closed fairing storage box 1800 with attachment straps 1802. FIG. 24 shows an example of a collapsible fairing 100 partially deployed from the fairing storage box 1800. FIG. 25 shows an example of the collapsible fairing 100 fully deployed from the fairing storage box 1800.

Figure 26:
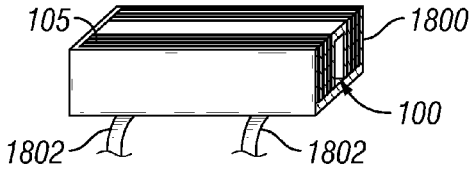
FIG. 26 is a collapsible fairing storage box with attachment straps and with an embodiment of the stowed collapsible fairing.
Figure 27:
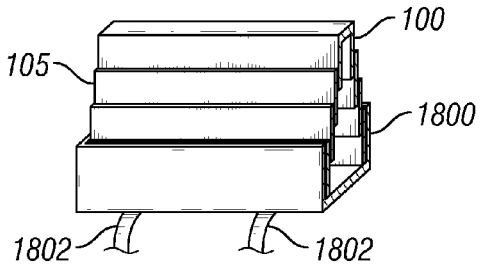
FIG. 27 is a collapsible fairing storage box with attachment straps and with the collapsible fairing of FIG. 26 partially deployed.
Figure 28:
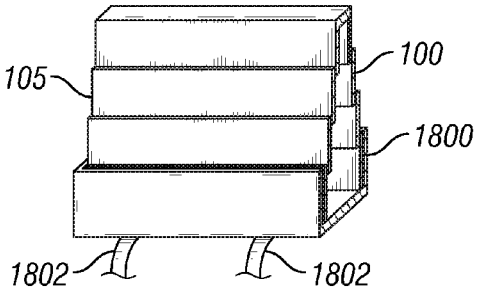
FIG. 28 is a collapsible fairing storage box with attachment straps and with the collapsible fairing of FIGS. 26 and 27 fully deployed.
Figure 29:
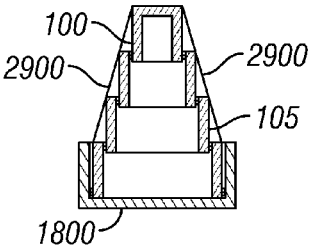
FIG. 29 is a cross section of the collapsible fairing storage box of FIGS. 26-28 with the fairing fully deployed with an additional cover section.

FIGS. 26-28 illustrate another embodiment of the collapsible fairing 100 and fairing storage box 1800. FIG. 26 shows the fully collapsed fairing stowed in the fairing storage box 1800. The collapsible fairing in this embodiment is made up of panels 105. Each panel 105 is about the height of the fairing storage box 1800 ensuring a flush fit when stowed. FIG. 27 illustrates the collapsible fairing 100 partially deployed. FIG. 28 illustrates the fully deployed collapsible fairing 100. FIG. 29 shows the cross section of the fully deployed collapsible fairing of this embodiment. The collapsible fairing 100 may additionally include malleable material panels 2900 spanning the space between the tops of the fairing panels to allow for a smooth foil.

Figure 30:
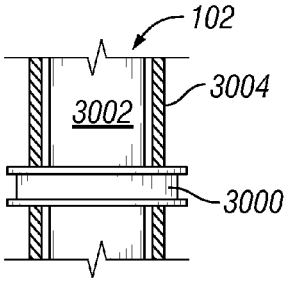
FIG. 30 is a profile view of a riser including a channel for securing an attachment strap.
Figure 31:
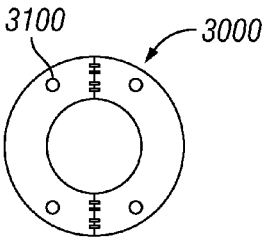
FIG. 31 is another view of a channel for securing an attachment strap.

FIG. 30 illustrates an example of a collapsible fairing attachment. In this embodiment any of the fairing structures shown in FIGS. 1-11 and 16-29 may be attached to the riser 102 by a securing strap channel 3000. This securing strap channel 3000 is securely attached around the bare joint 3002. Choke and kill lines 3004 extend through the securing strap channel through holes 3100 in the channel, as shown in FIG. 31. Attachment straps 1802 would be secured to the securing strap panel 3000 in such as way as to allow free movement of the fairing around the securing strap panel 3000. In this way the fairing would rotate around the riser 102 with changing directions of current.

Figure 32:
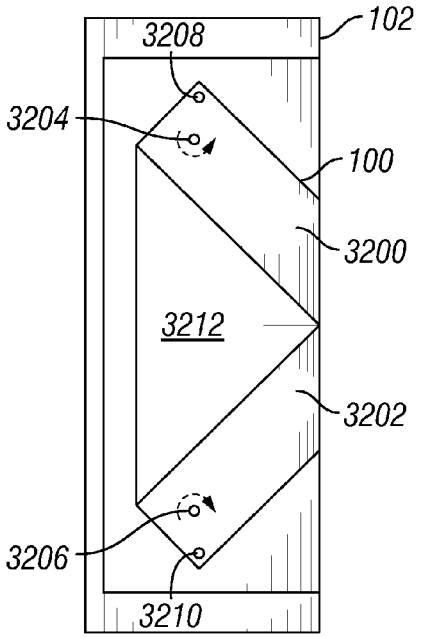
FIG. 32 is a profile view of a riser with a collapsible fairing comprising two rotatable stowed wings.
Figure 33:
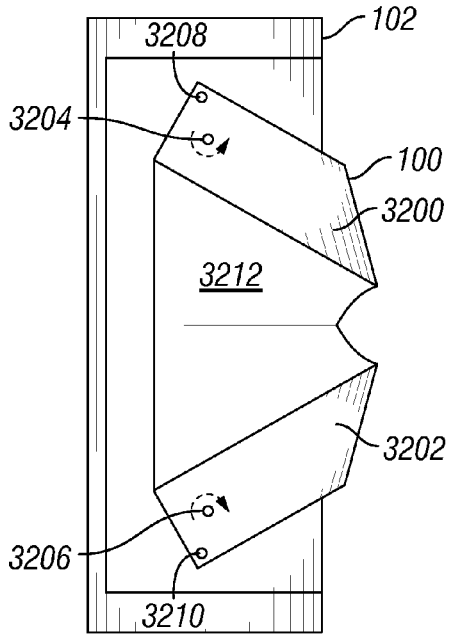
FIG. 33 is a profile view of a riser with a collapsible fairing comprising two rotatable wings partially deployed.
Figure 34:
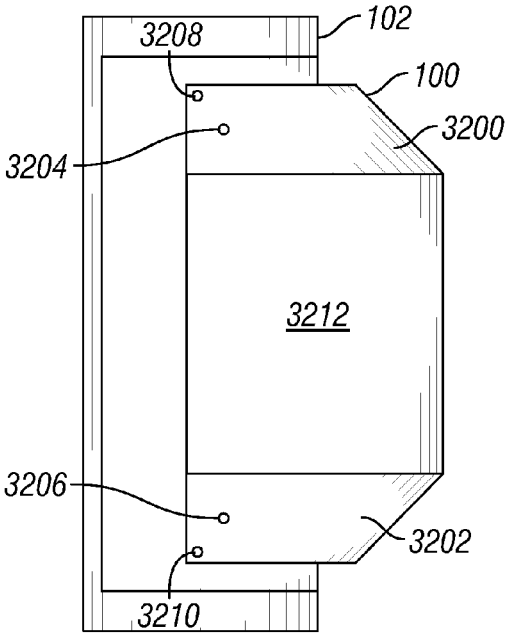
FIG. 34 is a profile view of a riser with a collapsible fairing comprising two rotatable wings fully deployed.

FIGS. 32-34 illustrate another embodiment of the collapsible fairing 100 structure. In this embodiment the collapsible fairing 100 is comprised of two wing like structures 3200 and 3202 spaced apart, as shown in FIG. 32. FIG. 32 shows the wing like structures 3200 and 3202 in the stowed position. The wing like structures 3200 and 3202 are attached to the riser by a means that allows the wings to rotate away from the riser 102 as shown in elements 3208 and 3210. The wing like structures 3200 and 3202 may additionally comprise latch knobs 3204 and 3206 that facilitate the rotation of the wing like panels, and lock the wing like structures into place when fully deployed or fully stowed. FIG. 33 shows the collapsible fairing 100 in a partially deployed condition. The collapsible fairing may additionally comprise a folded sheet of material 3212 that unfolds to create the body of the deployed collapsible fairing. FIG. 34 shows the collapsible fairing 100 in a fully deployed condition. In this embodiment, the collapsible fairing 100 hugs the riser 102 without having to store the fairing in an additional containment box.

Figure 35:
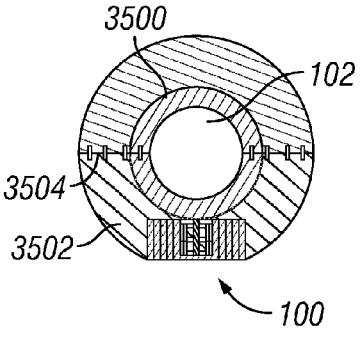
FIG. 35 illustrates a duel layer buoyancy joint with a collapsible fairing attachment.

FIGS. 35-38 illustrate another embodiment for attaching a collapsible riser fairing to a riser which is comprised of a buoyancy module made from two layers. The collapsible riser fairing embodiments of FIGS. 12-15, and 32-34 may be attached to the riser by the following attachment embodiment. FIG. 35 shows a buoyancy modules that is composed of two layers, the inner layer 3500 and an outer layer 3502. The layers be comprised of two separate sides which are attached around the riser 102 securely by mechanical attachments 3504. The inner 3500 and outer 3502 layers of the buoyancy joint may be comprised of buoyant or buoyant neutral material. The outer layer 3502 houses the collapsible fairing 100.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An apparatus containing a collapsible marine riser fairing for semi-permanent attachment to a marine riser comprising:

a storage system containing collapsible fairing members having retractable components for retracting into and being deployed from the storage system, wherein the storage system is fully contained on the riser;

the storage system including members for semi-permanently attaching the storage system to a riser or a storage system module for semi-permanently attaching the fairing within a portion of the riser in which the storage system module is contained within vertical boundaries of the riser;

wherein the storage system allows for rotation of the fairing about a vertical axis of the riser.

2. The apparatus of claim 1, wherein the storage system is in the form of a box.

3. The apparatus of claim 1, wherein the storage system members comprise low friction attachment straps for attaching the storage system to the riser.

4. The apparatus of claim 1, wherein the storage system module is contained within a space in a buoyancy joint or an encapsulated joint of the riser.

5. The apparatus of claim 4, wherein the storage system module is fully contained within the buoyancy joint space or within the encapsulated joint of the riser.

6. The apparatus of claim 1, wherein the retractable components of the fairing members comprises interlocking panels that fold into the storage system and form a pyramid type shape when deployed.

7. The apparatus of claim 6, wherein the interlocking panels include locking studs.

8. The apparatus of claim 1, wherein the storage system further comprises a deployment mechanism for deploying the collapsible fairing from the storage system.

9. The apparatus of claim 8, wherein the deployment mechanism is a scissor jack.

10. The apparatus of claim 1, wherein the retractable components of the fairing members comprise foldable sections that collapse to a map fold or an accordion fold.

11. The apparatus of claim 1, wherein the retractable components of the fairing members comprise two wing like structures that are spaced apart from each other and rotate away from the riser upon deployment from the storage system module.

* * * * *